US010526167B2

(12) United States Patent
Ozawa et al.

(10) Patent No.: US 10,526,167 B2
(45) Date of Patent: Jan. 7, 2020

(54) RESTORATION INFORMATION REGISTRATION DEVICE AND RESTORATION INFORMATION REGISTRATION METHOD FOR ELEVATORS

(71) Applicant: Mitsubishi Electric Corporation, Chiyoda-ku (JP)

(72) Inventors: Masafumi Ozawa, Tokyo (JP); Akihiko Watanabe, Tokyo (JP); Norihiro Chotoku, Tokyo (JP); Yutaka Matsueda, Tokyo (JP); Masaki Hikichi, Tokyo (JP); Masafumi Eto, Tokyo (JP); Takeshi Fujita, Tokyo (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 0 days.

(21) Appl. No.: 15/567,675

(22) PCT Filed: Apr. 20, 2016

(86) PCT No.: PCT/JP2016/062466
§ 371 (c)(1),
(2) Date: Oct. 19, 2017

(87) PCT Pub. No.: WO2016/181775
PCT Pub. Date: Nov. 17, 2016

(65) Prior Publication Data

US 2018/0111790 A1 Apr. 26, 2018

(30) Foreign Application Priority Data

May 13, 2015 (JP) ..... 2015-097845

(51) Int. Cl.
*B66B 1/34* (2006.01)
*B66B 5/00* (2006.01)
*B66B 3/00* (2006.01)

(52) U.S. Cl.
CPC ..... *B66B 1/3453* (2013.01); *B66B 1/3461* (2013.01); *B66B 3/00* (2013.01); *B66B 5/0025* (2013.01); *B66B 5/0087* (2013.01)

(58) Field of Classification Search
CPC ..... B66B 1/3453; B66B 1/3423; B66B 1/343; B66B 1/3438; B66B 1/3446; B66B 1/346;
(Continued)

(56) References Cited

U.S. PATENT DOCUMENTS 6,488,127 B2 * 12/2002 Mori ..... B66B 3/00 187/247
2010/0211304 A1 * 8/2010 Hwang ..... G01C 21/3484 701/532
(Continued)

FOREIGN PATENT DOCUMENTS

CN 102862882 A 1/2013
JP 07172729 A * 7/1995
(Continued)

OTHER PUBLICATIONS

International Preliminary Report on Patentability and Written Opinion dated Nov. 23, 2017 in PCT/JP2016/062466 (submitting English translation only).
(Continued)

*Primary Examiner* — Magdi Elhag
(74) *Attorney, Agent, or Firm* — Oblon, McClelland, Maier & Neustadt, L.L.P.

(57) ABSTRACT

A restoration information registration device for elevators capable of quickly registering restoration information on the elevator. The restoration information registration device for the elevators includes an operation unit that receives an operation from the outside, a storage unit that stores, when restoration information on the elevator is input by the operation on the operation unit, the restoration information,
(Continued)

and a transmission unit that, when restoration information on a plurality of elevators is stored in the storage unit, collectively transmits the restoration information on the plurality of elevators. Accordingly, it is possible to quickly register the restoration information on the elevator.

9 Claims, 4 Drawing Sheets

(58) Field of Classification Search
CPC ..... B66B 1/3415; B66B 1/3461; B66B 3/00; B66B 5/0025; B66B 5/0087
See application file for complete search history.

(56) References Cited

U.S. PATENT DOCUMENTS

| | | | | |
|---|---|---|---|---|
| 2011/0072089 | A1* | 3/2011 | Broman | H04L 67/02 709/206 |
| 2013/0246928 | A1 | 9/2013 | Hovi et al. | |
| 2018/0150806 | A1* | 5/2018 | Eleid | B66B 25/006 |

FOREIGN PATENT DOCUMENTS

| | | | | |
|---|---|---|---|---|
| JP | 10-7337 | A | | 1/1998 |
| JP | 10007337 | A | * | 1/1998 |
| JP | 2007106547 | A | * | 4/2007 |
| JP | 2008-37603 | A | | 2/2008 |
| JP | 2008-242553 | A | | 10/2008 |
| JP | 2008-247553 | A | | 10/2008 |
| JP | 2008242553 | A | * | 10/2008 |
| JP | 2009214994 | A | * | 9/2009 |
| JP | 2010163284 | A | * | 7/2010 |
| JP | 2011-201621 | A | | 10/2011 |
| JP | 2015044667 | A | * | 3/2015 |
| KR | 10-1999-0003221 | | | 1/1999 |

OTHER PUBLICATIONS

International Search Report dated Jun. 28, 2016 in PCT/JP2016/062466 filed Apr. 20, 2016.
Japanese Office Action dated Sep. 5, 2017 in JP 2015-097845 filed May 13, 2015 (with partial English translation).
Combined Office Action and Search Report dated Nov. 9, 2018 in Chinese Patent Application No. 201680026566.9, 13 pages (with unedited computer generated English translation of the Office Action and English translation of categories of cited documents).
Combined Office Action and Search Report dated Dec. 6, 2018 in Taiwanese Patent Application No. 105113232, 9 pages (with unedited computer generated English translation).
Office Action dated Jan. 21, 2019 in Korean Application No. 10-2017-7035034 (w/computer-generated English translation.)
Office Action dated Jul. 30, 2019 in Korean Application No. 10-2017-7035034.

* cited by examiner

RESTORATION INFORMATION REGISTRATION DEVICE AND RESTORATION INFORMATION REGISTRATION METHOD FOR ELEVATORS

TECHNICAL FIELD

The invention relates to a restoration information registration device and a restoration information registration method for elevators.

BACKGROUND ART

PTL 1 discloses a monitoring system for elevators. In the monitoring system, transmission and reception of information are performed between a mobile terminal and a monitoring center.

CITATION LIST

Patent Literature

[PTL 1] Japanese Patent Application Publication No. 2008-247553

SUMMARY OF INVENTION

Technical Problem

For example, in the case where a disaster such as an earthquake occurs, many elevators stop due to an emergency. Information related to the situation of the elevator is gathered in a restoration information management device in the monitoring center. A worker performs identification of the elevator that is not restored and registration of restoration information indicative of restoration of the elevator by using the mobile terminal. At this point, when many workers try to access the restoration information management device, traffic to the restoration information management device is increased. As a result, congestion occurs. In this case, it is not possible to quickly register the restoration information on the elevator.

The invention has been made in order to solve the above problem. An object of the invention is to provide a restoration information registration device and a restoration information registration method for elevators capable of quickly registering the restoration information on the elevator.

Solution to Problem

A restoration information registration device for elevators according to the invention includes an operation unit configured to receive an operation from an outside, a storage unit configured to store, when restoration information on an elevator is input by the operation on the operation unit, the restoration information, and a transmission unit configured to, when restoration information on a plurality of elevators is stored in the storage unit, collectively transmit the restoration information on the plurality of elevators.

A restoration information registration method for elevators according to the invention includes a storage step for causing a restoration information registration device to store restoration information on an elevator, and a transmission step for, when restoration information on a plurality of elevators is stored in the restoration information registration device, causing the restoration information registration device to collectively transmit the restoration information on the plurality of elevators.

Advantageous Effects of Invention

According to the inventions, the restoration information on the plurality of elevators is collectively transmitted. Accordingly, it is possible to quickly register the restoration information on the elevator.

DESCRIPTION OF EMBODIMENT

Figure 1:
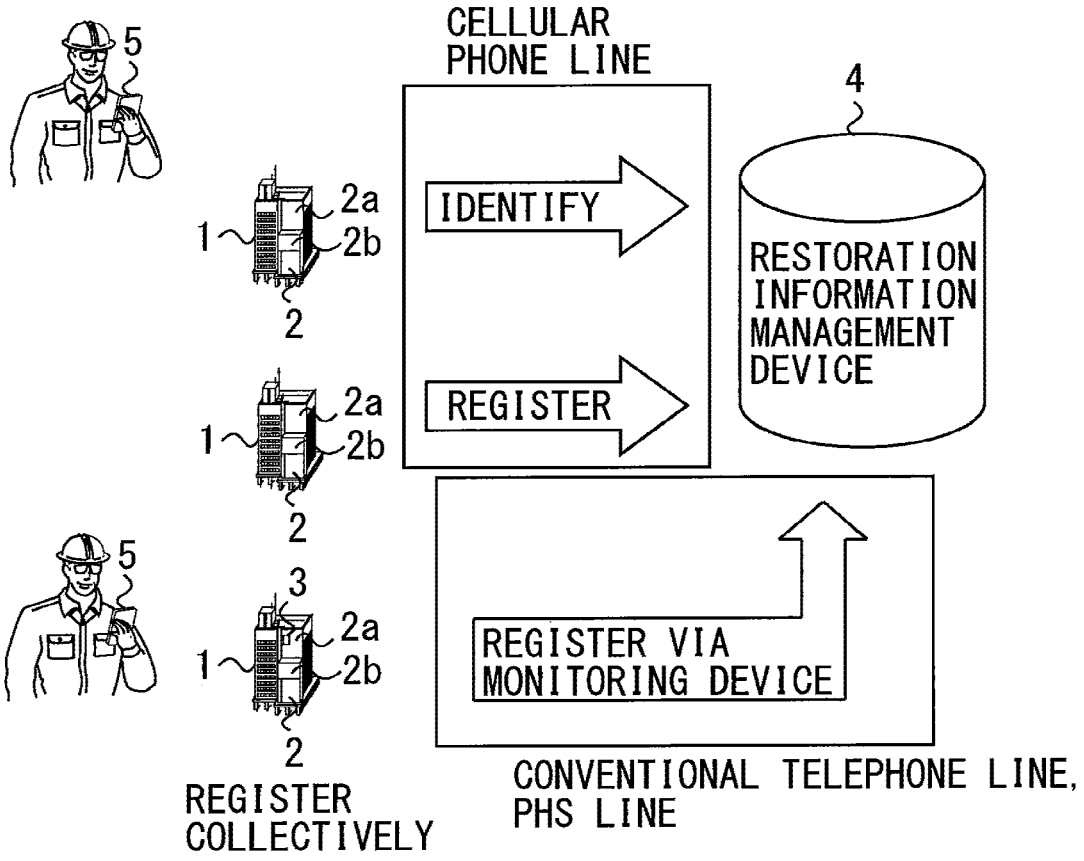
FIG. 1 is a configuration diagram of a system to which a restoration information registration device for elevators in Embodiment 1 of the invention is applied.

Embodiment will be described according to the accompanying drawings. Note that, in each drawing, the same or corresponding parts are designated by the same reference numerals. The repeated description of the parts will be appropriately simplified or omitted.

Embodiment 1

FIG. 1 is a configuration diagram of a system to which a restoration information registration device for elevators in Embodiment 1 of the invention is applied.

In FIG. 1, each of a plurality of buildings 1 includes an elevator 2. For example, the elevator 2 is constituted by a lift. Each elevator 2 includes a hoistway 2*a*. Each hoistway 2*a* passes through each building 1. Each car 2*b* is provided inside each hoistway 2*a*.

For example, a monitoring device 3 is provided in at least one elevator 2. For example, a restoration information management device 4 is provided in a maintenance company of the elevator 2. The monitoring device 3 and the restoration information management device 4 perform transmission and reception of information without the intervention of a cellular phone line. For example, the monitoring device 3 and the restoration information management device 4 perform the transmission and reception of information via at least one of a conventional telephone line and a PHS line.

For example, in the case where a disaster such as a large-scale earthquake occurs, many elevators 2 stop due to an emergency. At this point, a worker carries a restoration information registration device 5. For example, the restoration information registration device 5 is a cellular phone. For example, the restoration information registration device 5 is constituted by a smartphone.

The worker accesses the restoration information management device 4 via the cellular phone line by operating the restoration information registration device 5. The worker performs identification of the elevator 2 that is not restored based on restoration information stored in the restoration information management device 4. Thereafter, the worker goes to the identified elevator 2. Thereafter, the worker restores the identified elevator 2. The worker repeats the identification of the elevator 2 that is not restored and the restoration of the identified elevator 2.

Thereafter, the worker accesses the restoration information management device 4 via the cellular phone line or the monitoring device 3 by operating the restoration information registration device 5. Thereafter, the worker collectively registers the restoration information on a plurality of elevators 2 in the restoration information management device 4.

Next, the restoration information registration device 5 will be described by using FIG. 2.

Figure 2:
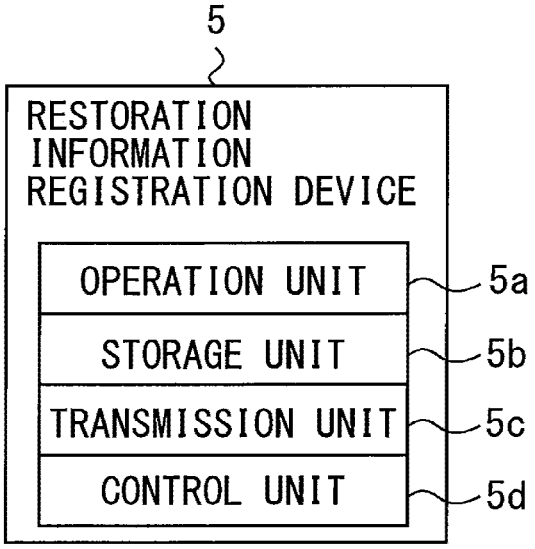
FIG. 2 is a block diagram of the restoration information registration device for elevators in Embodiment 1 of the invention.

FIG. 2 is a block diagram of the restoration information registration device for elevators in Embodiment 1 of the invention.

As shown in FIG. 2, the restoration information registration device 5 includes an operation unit 5*a*, a storage unit 5*b*, a transmission unit 5*c*, and a control unit 5*d*.

The operation unit 5*a* receives an operation from the outside. When the restoration information on the elevator 2 is input by the operation on the operation unit 5*a*, the storage unit 5*b* stores the restoration information. When restoration information on a plurality of elevators 2 is stored in the storage unit 5*b*, the transmission unit 5*c* collectively transmits the restoration information on the plurality of elevators 2. The control unit 5*d* controls the operation of the restoration information registration device 5.

For example, when the restoration information on the plurality of elevators 2 is stored in the storage unit 5*b*, the control unit 5*d* causes the transmission unit 5*c* to periodically transmit the restoration information on the plurality of elevators 2. For example, when the restoration information on the plurality of elevators 2 is stored in the storage unit 5*b*, the control unit 5*d* causes the transmission unit 5*c* to transmit the restoration information on the plurality of elevators 2 at intervals of 10 minutes.

For example, when the restoration information on the plurality of elevators 2 is stored in the storage unit 5*b*, in the case where the amount of the restoration information on the plurality of elevators 2 exceeds a preset amount, the control unit 5*d* causes the transmission unit 5*c* to transmit the restoration information on the plurality of elevators 2. For example, in the case where the restoration information on five elevators 2 is stored in the storage unit 5*b*, the control unit 5*d* causes the transmission unit 5*c* to transmit the restoration information on the five elevators 2.

For example, when the restoration information on the plurality of elevators 2 is stored in the storage unit 5*b*, the control unit 5*d* causes the transmission-unit 5*c* to transmit the restoration information on the plurality of elevators 2 to the monitoring device 3.

Next, an example of the restoration information registration device 5 will be described by using FIG. 3.

Figure 3:
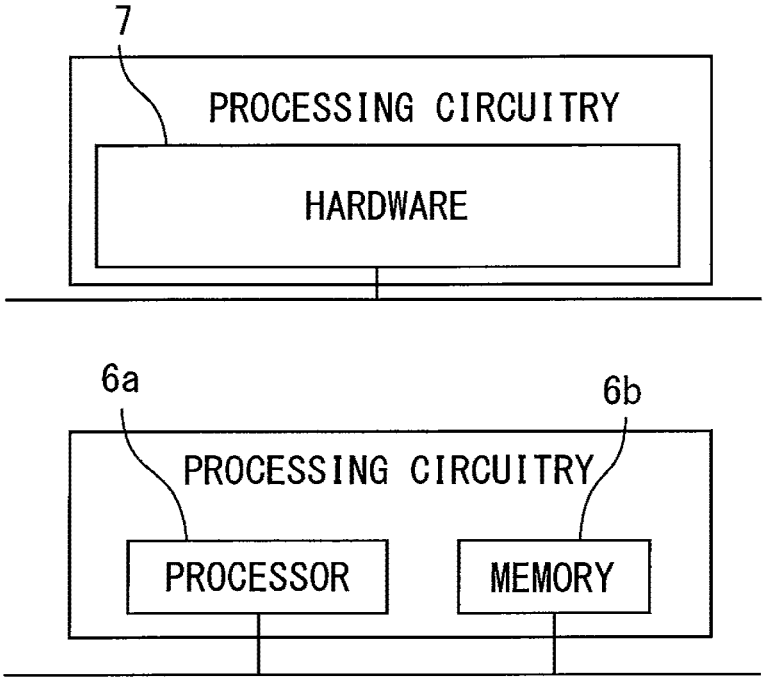
FIG. 3 is a hardware configuration diagram of the restoration information registration device for elevators in Embodiment 1 of the invention.

FIG. 3 is a hardware configuration diagram of the restoration information registration device for elevators in Embodiment 1 of the invention.

The individual functions of the restoration information registration device 5 are implemented by a processing circuitry. For example, the processing circuitry includes at least one processor 6*a* and at least one memory 6*b*. For example, the processing circuitry includes at least one dedicated hardware 7.

In the case where the processing circuitry includes at least one processor 6*a* and at least one memory 6*b*, the individual functions of the restoration information registration device 5 are implemented by software, firmware, or a combination of the software and the firmware. At least one of the software and the firmware is described as a program. At least one of the software and the firmware is stored in at least one memory 6*b*. At least one processor 6*a* implements the individual functions of the restoration information registration device 5 by reading and executing a program stored in at least one memory 6*b*. At least one processor 6*a* is also referred to as a CPU (Central Processing Unit), a central processor, a processing unit, an arithmetic unit, a microprocessor, a microcomputer, or a DSP. For example, the memory 6*b* is a non-volatile or volatile semiconductor memory such as a RAM, a ROM, a flash memory, an EPROM, or an EEPROM, a magnetic disk, a flexible disk, an optical disk, a compact disk, a minidisc, or a DVD.

In the case where the processing circuitry includes at least one dedicated hardware 7, For example, the processing circuitry is a single circuitry, a composite circuitry, a programmed processor, a parallel-programmed processor, an ASIC, an FPGA, or a combination thereof. For example, each of the functions of the restoration information registration device 5 is implemented by the processing circuitry. For example, the individual functions of the restoration information registration device 5 are collectively implemented by the processing circuitry.

With regard to the individual functions of the restoration information registration device 5, part thereof may be implemented by the dedicated hardware 7, and part thereof may be implemented by software or firmware. For example, the functions of the operation unit 5*a*, the storage unit 5*b*, and the transmission unit 5*c* may be implemented by the processing circuitry as the dedicated hardware 7, and the function of the control unit 5*d* may be implemented by reading and executing a program stored in at least one memory 6*b* by at least one processor 6*a*.

Thus, the processing circuitry implements the individual functions of the restoration information registration device 5 by the hardware 7, the software, the firmware, or the combination thereof.

Next, the operation of the restoration information registration device 5 will be described by using FIG. 4.

Figure 4:
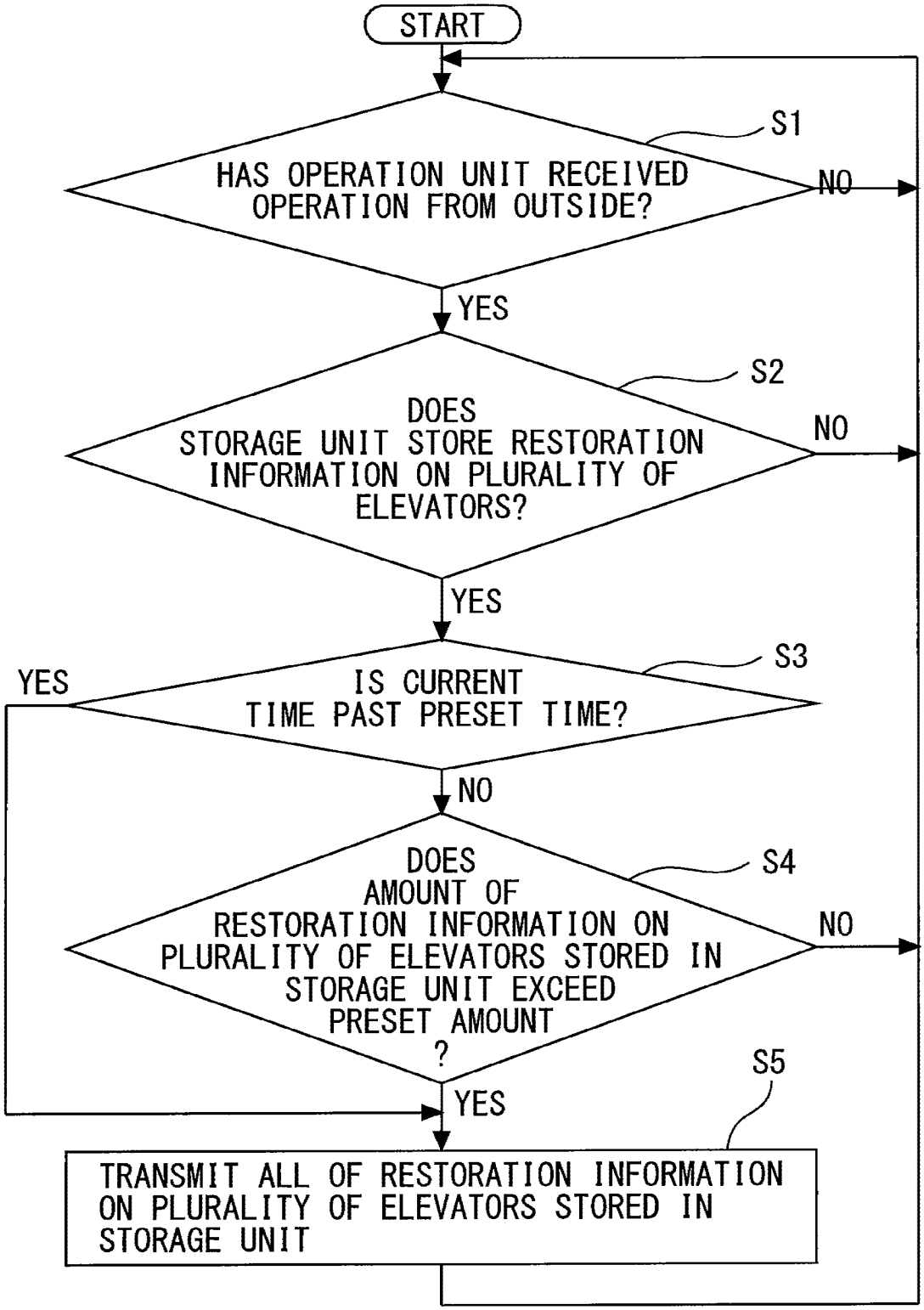
FIG. 4 is a flowchart for explaining an operation of the restoration information registration device for elevators in Embodiment 1 of the invention.

FIG. 4 is a flowchart for explaining the operation of the restoration information registration device for elevators in Embodiment 1 of the invention.

In Step S1, the control unit 5*d* determines whether or not the operation unit 5*a* has received the operation from the outside. In the case where the operation unit 5*a* has not received the operation from the outside in Step S1, Step S1 is repeated. In the case where the operation unit 5*a* has received the operation from the outside in Step S1, the flow proceeds to Step S2.

In Step S2, the control unit 5*d* determines whether or not the storage unit 5*b* stores the restoration information on the plurality of elevators 2. In the case where the storage unit 5*b* does not store the restoration information on the plurality of elevators 2 in Step S2, the flow returns to Step S1. In the case where the storage unit 5*b* stores the restoration information on the plurality of elevators 2 in Step S2, the flow proceeds to Step S3.

In Step S3, the control unit 5*d* determines whether or not the current time is past a preset time.

In the case where the current time is not past the preset time in Step S3, the flow proceeds to Step S4. In Step S4, the control unit 5*d* determines whether or not the amount of the restoration information on the plurality of elevators 2 stored in the storage unit 5*b* exceeds the preset amount.

In the case where the amount of the restoration information on the plurality of elevators 2 stored in the storage unit 5*b* does not exceed the preset amount in Step S4, the flow returns to Step S1.

In the case where the current time is past the preset time in Step S3 and the case where the amount of the restoration information on the plurality of elevators 2 stored in the storage unit 5*b* exceeds the preset amount in Step S4, the flow proceeds to Step S5.

In Step S5, the control unit 5*d* causes the transmission unit 5*c* to transmit all of the restoration information on the plurality of elevators 2 stored in the storage unit 5*b*. Thereafter, the flow returns to Step S1.

According to Embodiment 1 described thus far, the restoration information on the plurality of elevators 2 is automatically and collectively transmitted. Accordingly, it is not necessary to register the restoration information for each elevator 2. In this case, congestion in the restoration information management device 4 is suppressed. As a result, it is possible to quickly register the restoration information on the elevator 2.

At this point, the restoration information registration device 5 needs information for establishing access to the restoration information management device 4. When the restoration information on the plurality of elevators 2 is collectively transmitted, it is possible to reduce the total amount of the information for establishing access to the restoration information management device 4.

In addition, when the restoration information on the plurality of elevators 2 is stored in the storage unit 5*b*, the transmission unit 5*c* automatically transmits the restoration information on the plurality of elevators 2 periodically. Accordingly, it is possible to quickly register the restoration information on the elevator 2 without the operation of the worker.

Further, when the restoration information on the plurality of elevators 2 is stored in the storage unit 5*b*, in the case where the amount of the restoration information on the plurality of elevators 2 exceeds the preset amount, the transmission unit 5*c* automatically transmits the restoration information on the plurality of elevators 2. Accordingly, it is possible to quickly register the restoration information on the elevator 2 without the operation of the worker.

In addition, when the restoration information on the plurality of elevators 2 is stored in the storage unit 5*b*, the transmission unit 5*c* transmits the restoration information on the plurality of elevators 2 to the monitoring device 3. Accordingly, even in the case where the cellular phone line is congested, it is possible to quickly register the restoration information on the elevator 2 by using other lines.

INDUSTRIAL APPLICABILITY

Thus, the restoration information registration device for elevators according to the invention can be used in the system in which the restoration information on the elevator is quickly registered.

REFERENCE SIGNS LIST

1 Building
2 Elevator
2*a* Hoistway
2*b* Car
3 Monitoring device
4 Restoration information management device
5 Restoration information registration device
5*a* Operation unit
5*b* Storage unit
5*e* Transmission unit
5*d* Control unit
6*a* Processor
6*b* Memory
7 Hardware

The invention claimed is:

1. A restoration information registration device for elevators, comprising:

processing circuitry configured to:

receive, via cellular phone communication, identification information of one or more elevators that are not restored following a disaster event, from a restoration information management device;

receive an operation from a user;

store, when restoration information on an elevator, among the one or more elevators, is input by the user operation, the restoration information in a memory;

when restoration information on a plurality of elevators is stored in a memory, output a transmission instruction for automatically and collectively transmitting the restoration information on the plurality of elevators; and automatically and collectively transmit, via wireless communication, the restoration information on the plurality of elevators stored in the memory based on the transmission instruction to a monitoring device that is provided on one of the plurality of elevators, which causes the monitoring device to transmit the restoration information to the restoration information management device via a non-cellular telephone line.

2. The restoration information registration device for elevators according to claim 1, wherein the processing circuitry outputs a transmission instruction to periodically transmit the restoration information on the plurality of elevators, for every one of a predetermined time interval, when the restoration information on the plurality of elevators is stored.

3. The restoration information registration device for elevators according to claim 1, wherein the processing circuitry outputs a transmission instruction to transmit the restoration information on the plurality of elevators when an amount of the restoration information on the plurality of elevators exceeds a preset amount when the restoration information on the plurality of elevators is stored.

4. The restoration information registration device for elevators according to claim 1, wherein the processing circuitry outputs a transmission instruction to transmit the restoration information on the plurality of elevators when that a current time is past a preset time when the restoration information on the plurality of elevators is stored.

5. A restoration information registration method, implemented by a restoration information registration device, comprising:

receiving, via cellular phone communication, identification information of one or more elevators that are not restored following a disaster event, from a restoration information management device;

storing restoration information on an elevator, among the one or more elevators, in a memory;

when restoration information on a plurality of elevators is stored, outputting by processing circuitry, a transmission instruction for automatically and collectively transmitting the restoration information on the plurality of elevators; and automatically and collectively transmitting, via wireless communication controlled by the processing circuitry, the restoration information on the plurality of elevators stored based on the transmission instruction to a monitoring device that is provided on one of the plurality of elevators, which causes the monitoring device to transmit the restoration information to the restoration information management device via a non-cellular telephone line.

6. The restoration information registration method for elevators according to claim 5, further comprising:

outputting a transmission instruction to periodically transmit the restoration information on the plurality of elevators, for every one of a predetermined time interval, when the restoration information on the plurality of elevators is stored.

7. The restoration information registration method for elevators according to claim 5, further comprising:

outputting a transmission instruction to transmit the restoration information on the plurality of elevators when an amount of the restoration information on the plurality of elevators exceeds a preset amount when the restoration information on the plurality of elevators is stored.

8. The restoration information registration method for elevators according to claim 5, further comprising:

outputting a transmission instruction to transmit the restoration information on the plurality of elevators when a current time is past a preset time when the restoration information on the plurality of elevators is stored.

9. A non-transitory computer-readable recording medium for storing therein a computer program that includes instructions which when executed on a computer causes the computer to execute a restoration information registration method comprising:

receiving, via cellular phone communication, identification information of one or more elevators that are not restored following a disaster event, from a restoration information management device;

storing restoration information on an elevator, among the one or more elevators, in a memory;

when restoration information on a plurality of elevators is stored, outputting a transmission instruction for automatically and collectively transmitting the restoration information on the plurality of elevators; and automatically and collectively transmitting, via wireless communication, the restoration information on the plurality of elevators stored based on the transmission instruction to a monitoring device that is provided on one of the plurality of elevators, which causes the monitoring device to transmit the restoration information to the restoration information management device via a non-cellular telephone line.

* * * * *